US005123885A

United States Patent [19]

Shields

[11] Patent Number: 5,123,885

[45] Date of Patent: Jun. 23, 1992

[54] FREEWEIGHT LOCKING MECHANISM

[75] Inventor: William D. Shields, Jacksonville, Fla.

[73] Assignee: Selex Sport/Health Industries, Inc., Jacksonville, Fla.

[21] Appl. No.: 580,093

[22] Filed: Sep. 10, 1990

[51] Int. Cl.[5] ..... A63B 13/00

[52] U.S. Cl. ..... 482/106; 482/107; 482/98

[58] Field of Search ..... 272/123, 118, 117, 122, 272/134, DIG. 4; 294/15

[56] References Cited

U.S. PATENT DOCUMENTS

| | | | |
|---|---|---|---|
| 4,529,198 | 7/1985 | Hettick | 272/123 |
| 4,822,034 | 4/1989 | Shields | 272/123 |
| 4,971,305 | 11/1990 | Renney | 272/118 |
| 4,971,318 | 11/1990 | Tracy | 272/123 |
| 4,982,957 | 1/1991 | Shields | 272/123 |

*Primary Examiner*—Richard J. Apley

*Assistant Examiner*—Jerome Donnelly

*Attorney, Agent, or Firm*—Arthur G. Yeager

[57] ABSTRACT

An improved freeweight locking mechanism employs a spring-biased lever having a locking end which blocks movement of the freeweight securing member from a first position whereby a weight is secured to a lifting bar and an operating end, which when contacted by the support frame for the weights, will cause the locking end to move a sufficient distance to allow movement of the weight-securing member to the release position. The member has a rib which defines two surfaces or shoulders to allow the member to be locked in either the weight-securing or weight-releasing positions. The movement of a weight away from the support frame allows spring bias to force the locking end of the lever into the locked position and this blocks accidental movement of the member from its weight-securing position.

41 Claims, 8 Drawing Sheets

FREEWEIGHT LOCKING MECHANISM

BACKGROUND OF THE INVENTION

1. Field of the Invention

The present invention relates to safety apparatus for use in freeweight barbell systems and in particular to improved weight-locking mechanisms for use therewith.

2. Prior Art

Freeweight barbell weight-lifting apparatus such as that disclosed in applicant's U.S. Pat. No. 4,822,034 employ locking mechanisms to inhibit or prevent movement of the movable members which are used to secure a weight to the lifting bar. The present invention is designed to provide a more secure locking mechanism for use with the weight-securing apparatus to minimize the possibility of inadvertent unlocking and thus release of a weight secured to the lifting bar while at the same time not interferring with the ease of use of the freeweight lifting system. The prior art locking device can be overcome by force on the weight-securing mechanism. The present invention requires positive action to release the lock and such action cannot be accomplished by intentional or inadvertent movement of the member.

BRIEF SUMMARY OF THE INVENTION

In one aspect of the present invention there is provided a barbell weight lifting apparatus including an elongated lifting bar, a plurality of planar weights adapted to be selectively attached to the bar, support means for positioning the weights upstanding in a horizontal row, selective means for detachably securing the weights to the bar, each weight having an identically positioned horizontally disposed lateral slot therein extending from an edge of the weight to generally medially thereof. The bar is positionable through each slot at respective weights and is selectively secured to the weights. The means for selectively attaching the weights to the bar includes a movable member mounted to each of the weights, each member having a first position wherein the member is downwardly disposed at least partially transversing the slot of its respective weight for securing the lifting bar in the slot and a second position wherein the member is disposed away from the slot for allowing free movement of the bar into and out of the slot. The improvement in the aforesaid apparatus includes selectively operable locking means carried by each weight for positively locking the member in the first position or blocking movement therefrom and preventing unlocking thereof while the weight is attached to the bar, the locking means being unaffected by intentional or inadvertent movement of the member while the weight is being supported on the bar.

Specific aspects are seen wherein the locking means includes an element selectively positionable to block movement of the member from the first position by contact therewith, the support means including means for selective operation of the locking means to move the element from a locked position in which the member is immovable from the first position when the element has been positioned to block such movement and an unlocked position in which the member is movable from the first position. The element preferably is spring-biased in a direction to position the element in the locked position and is operable by the means to override the spring bias of the element to position the element in the unlocked position. The means for selective operation of the locking means includes a wall. The member includes a forward portion and a rearward portion which has a downwardly disposed hook member. The wall has a plurality of laterally spaced slots for selective engagement by the hook members of respective members and is positioned to be closely adjacent the weights when the weights are upstandingly supported in a horizontal row by the support means. The member includes a shoulder to block movement of the member by contact between the shoulder and the element.

In other aspects of the present invention, the member includes a laterally extending rib having opposite end portions, each of which has a surface for contact with the locking means. The locking means includes a spring-biased lever arm pivotally mounted on each weight having a locking end portion and an operating end portion. The locking end portion is selectively positionable closely adjacent a respective surface of one end portion for inhibiting movement of the member from a respective first or second position by contact between the surface and the locking end portion. The lever arm can be pivotally mounted substantially in either the horizontal plane or the vertical plane.

BRIEF DESCRIPTION OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

Figure 2:
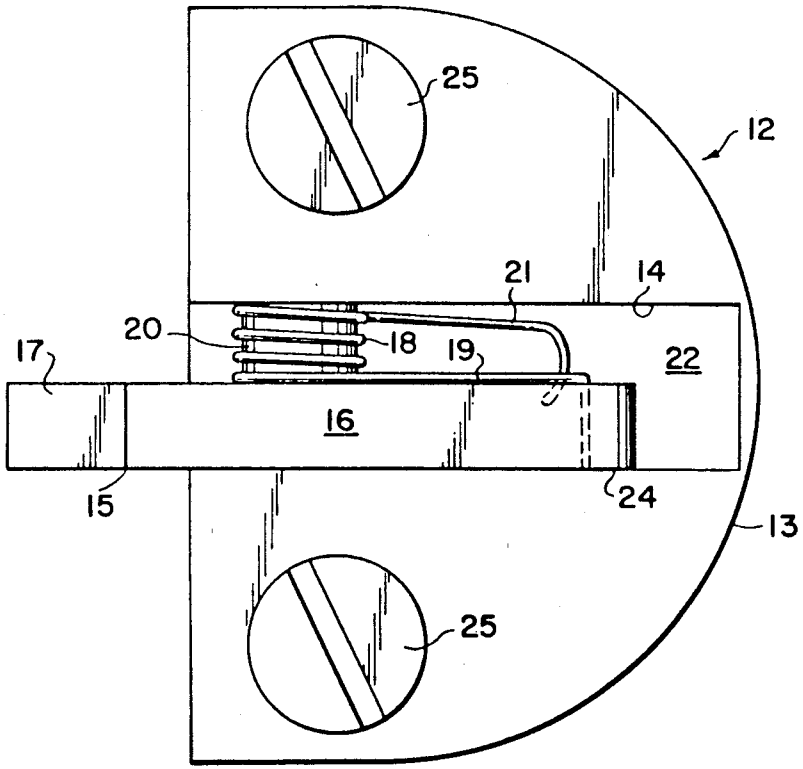
FIG. 2 is a rear view of the improved locking mechanism of FIG. 1.
Figure 1:
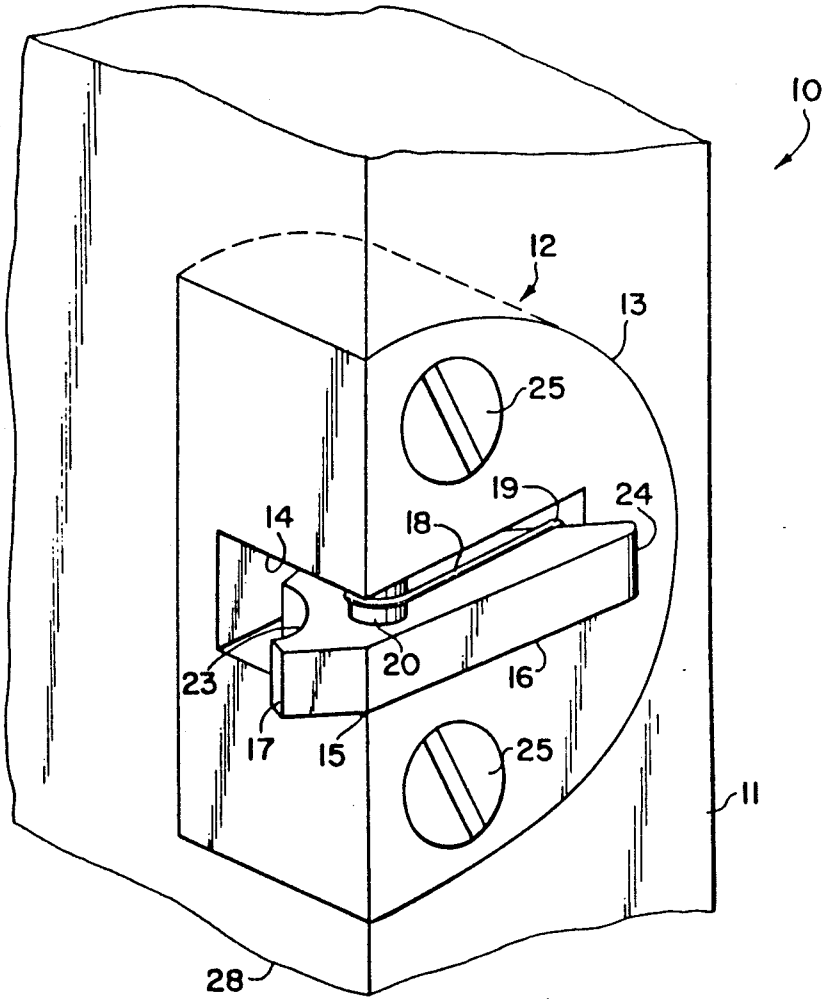
FIG. 1 is a cut away perspective of the improved locking mechanism in accord with the present invention shown installed in the rearward portion of a weight.
Figure 3:
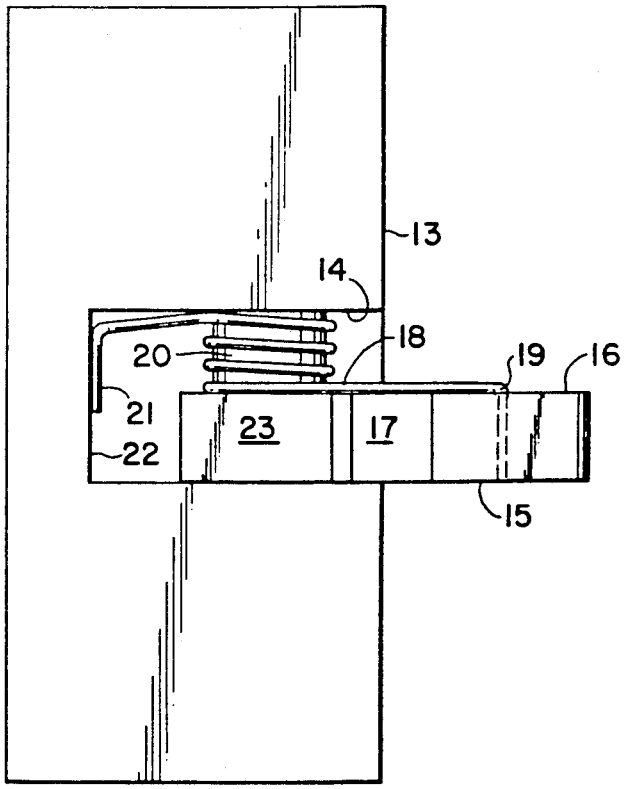
FIG. 3 is a right side elevation of the mechanism of FIG. 1.

With respect now to the drawings, the locking mechanism in accord with the present invention installed in a weight is depicted at numeral 10 in FIG. 1. The locking mechanism 12 is installed in the rear body portion of a weight 28 and includes a hemispherical body 13 with an interior space 14 cut out to accommodate the mounting of a lever arm 15 partially therein. The lever arm 15 has an operating end portion 16 and a locking end portion 17 and is pivotally mounted, against the bias of spring 18, on a post or axle 20. The spring 18 has an operating end 19 bent to apply force against operating end 19 of lever arm 15. As further illustrated in FIG. 2–4, the fixed end 21 of spring 18 is mounted to be in contact with the wall 22 that defines space 14. It can thus be understood that spring 18 applies force against lever arm 15 to move the operating end 16 outwardly as shown in solid line position "C" of FIG. 4. As can also be seen in FIG. 4, force applied in the horizontal plane against the outwardly extending end 24 of operating end 16 will cause the lever arm to pivot to the dotted line portion "D". The insert 12 is mounted in the rearward right hand side of a weight 28 via fastener 25 or other appropriate means.

Figure 4:
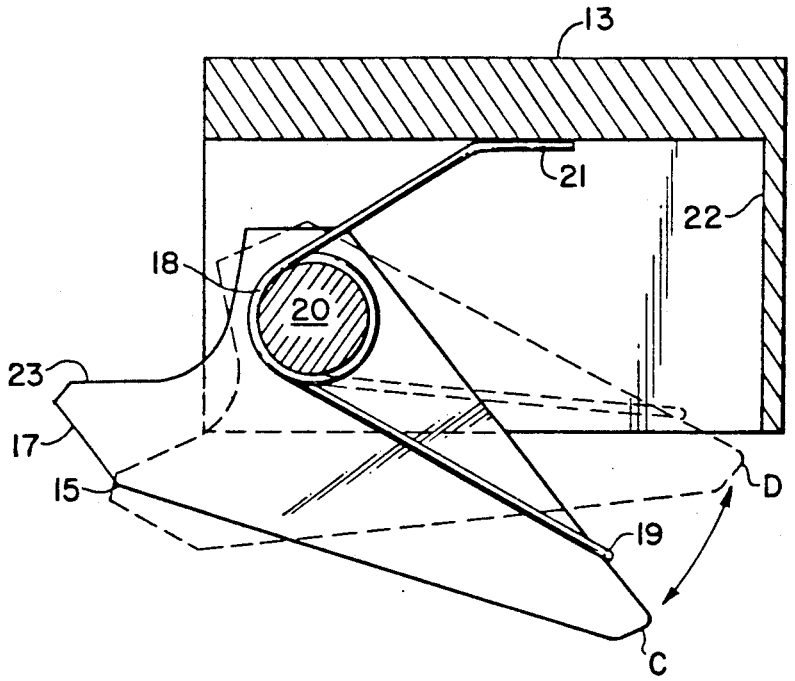
FIG. 4 is a top cut away view of the mechanism of FIG. 1 with the upper portion of the body removed.
Figure 5:
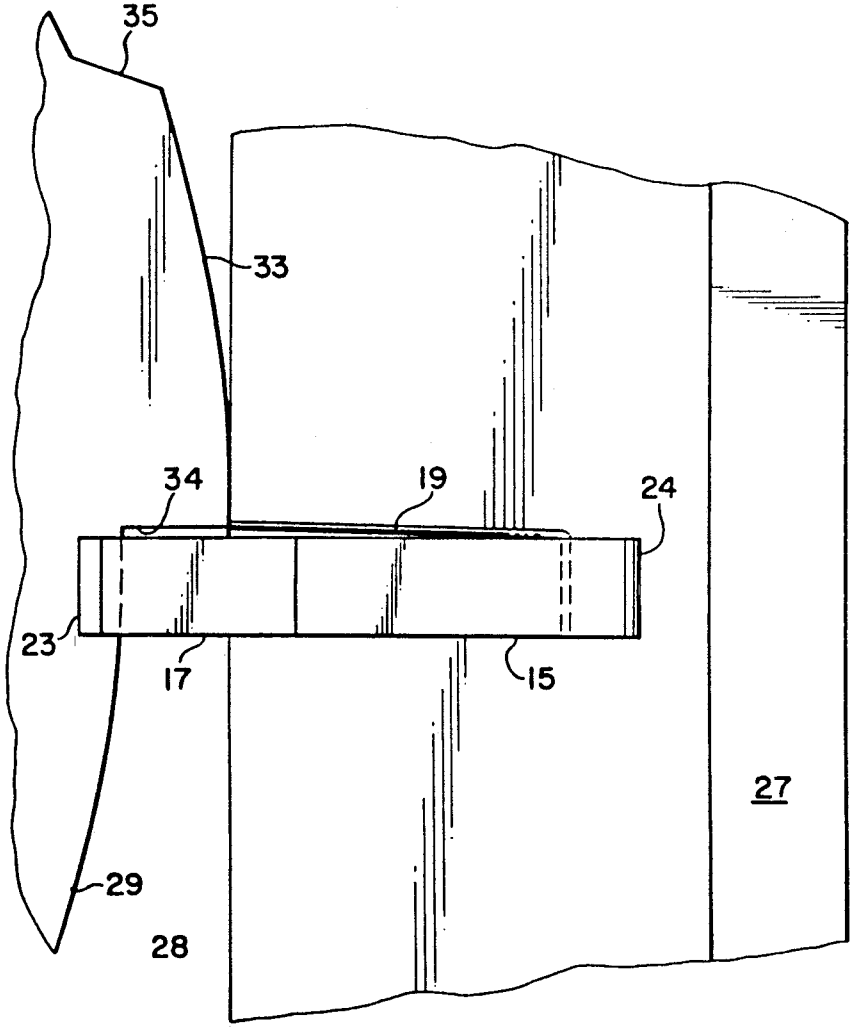
FIG. 5 is an enlarged right elevation of the locking mechanism lever arm positioned to block movement of a weight securing member.
Figure 6:
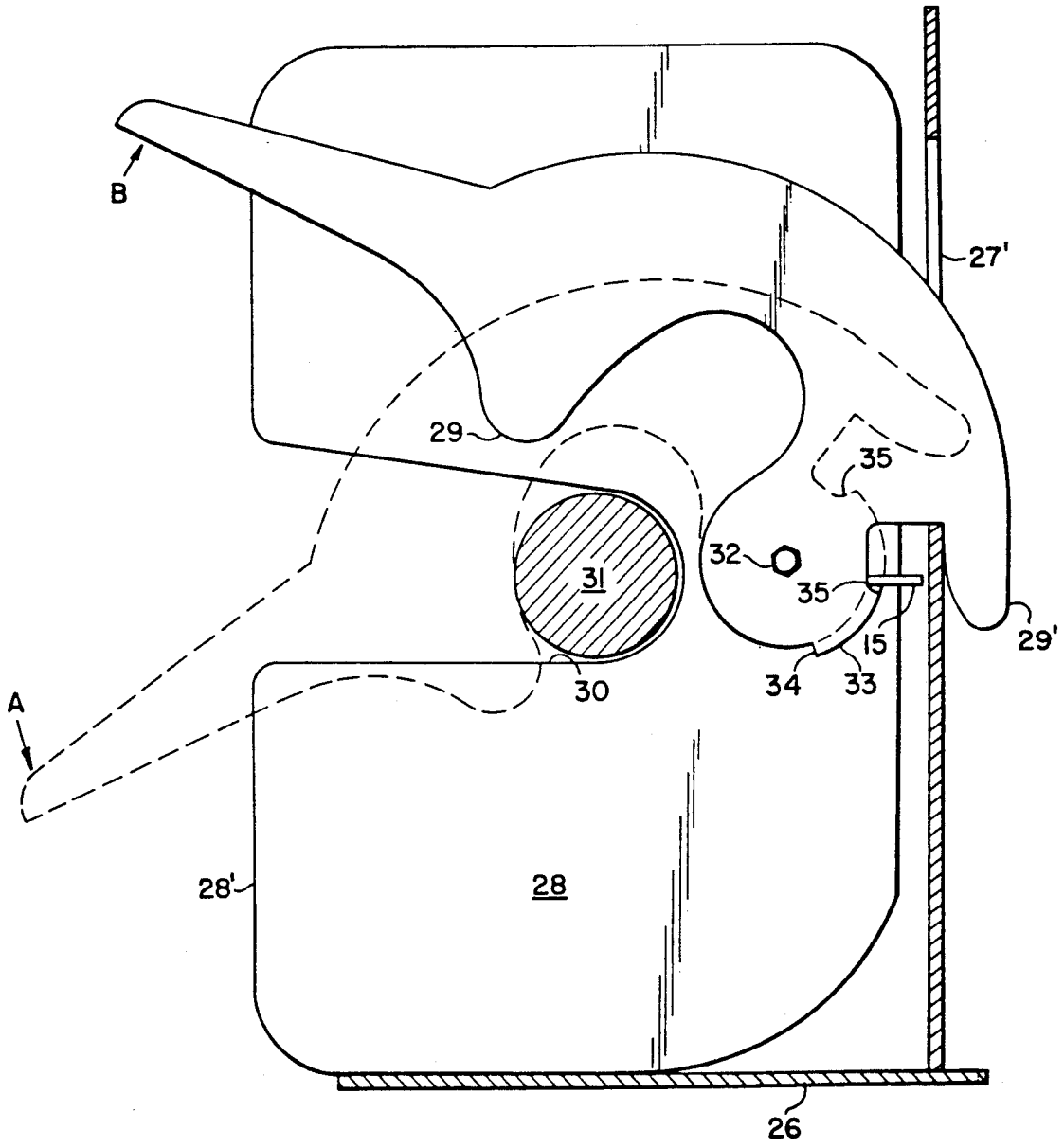
FIG. 6 is a side view of a weight employing the locking mechanism in accord with the present invention.

The locking mechanism 12 is designed to place the locking end 17 of the lever arm 15 in the path of the securing member 29 to block its movement. Force applied to operating end 16 at end portion 24 will cause locking end 17 to pivot rearward by a given distance and allow for movement of securing member 29. This operation can be illustrated with reference to FIGS. 4–5. Locking end 17 of the lever arm 15 is positioned below the surface or shoulder 34 of a rib or protrusion 33 that is integral with securing member 29 and positioned rearwardly. As shown in FIGS. 5–6, upward movement of member 29 will cause surface 34 to come into contact with lever arm locking end 17 and thus block movement of member 29. The forward face 23 of locking end 17 may contact member 29 depending upon the specific dimensions used for the various components. As shown in FIG. 6, the down position of dotted line "A" is that used to secure a weight 28 to the bar 31 which fits laterally into slot 30 extending to front edge 28'. Member 29 is pivotally mounted to weight 28 by fastener 32. Inadvertent upward movement of member 29 to the release position of solid line "B" could result in release of a weight 28 from bar 31. The locking mechanism 12 affirmatively blocks movement of the member 29 from the weight-securing dotted line position "A" by putting locking end 17 of the lever arm 15 in the downward path of rib 33 at surface 34. Lever arm 15 is spring-biased to put locking end 17 forward and accordingly, member 29 can be lifted to the weight-release position of solid line "B" only after positively moving the lever arm 15 from the locked position.

In the preferred embodiment of the present invention, movement of lever arm 15 in a manner to allow member 29 movement is accomplished by bringing end 24 of the lever 15 into contact with wall 27 which is part of the support frame 26 for the weight system. As shown in FIGS. 4–5, lever locking end 17 need only be moved rearwardly a distance greater than the lateral distance of rib 33 in order to allow clearance of rib 33 from lever 15 when member 29 is to be lifted.

The design of the locking mechanism 12 in accord with the present invention is based upon the idea that only when the weights are returned to the stored position on frame 26 will the member 29 be lifted to the release position. It can be seen that depending upon the exact dimensions used for the lever arm 15 and the degree of locking end 17 movement that must take place, the weights 28 may have to be very closely adjacent to wall 27 prior to weight 28 release and accordingly, weight 28 release will only occur when the weights 28 are positively in the stored position where inadvertent release poses no safety problem.

The present invention also contemplates locking the member 29 in the raised position by positioning locking end 17 in the path of upper rib surface 35 as shown in the solid line position "B" of FIG. 6. The slanted nature of surface 35 will allow the member 29 to be forcibly rotated against lever arm 15 causing it to pivot if such is desired. For example, support frame 26 may be designed such that the weights 28 must be moved rearwardly to position lever end 24 against wall 27 in order to release the weights 28 but allow them to be stored slightly forwardly of wall 27 to avoid continuous compression of spring 18 by force on operating arm 16. In this case, weights 28 could be secured onto the bar 31 by simply forcing member 29 downwardly. Finally, it may be desired that surface 35 be "flat" to require positive positioning of the weights prior to selection. This construction would depend upon the specific configuration the weight-lifting apparatus is in and what type of exercises are contemplated. In addition, protrusions from wall 27 may be used to provide contact with lever arm 15.

The weights 28 illustrated in FIG. 6 are generally rectangular in shape but may be circular or some other shape if desired. Also as described in U.S. Pat. No. 4,822,034, tab or hook member 29' is provided with the securing member 29 to prevent movement of an associated weight 28 when the member 29 is in the upraised position. The tab 29' fits with laterally spaced slots 27' of wall 27 and accordingly, forward movement of weight 28 is prevented.

Figure 7:
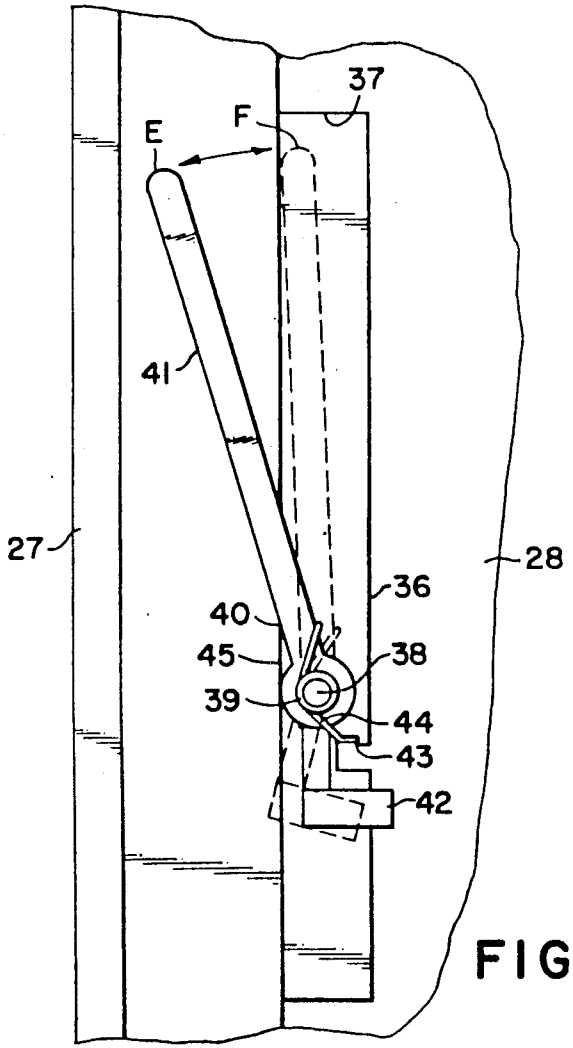
FIG. 7 is an enlarged cut away side view of an alternative embodiment of the present invention.

FIG. 7 illustrates an alternative embodiment of the present invention where the lever arm arrangement is mounted vertically. The embodiment can be used where the physical width of very light weights is not sufficient to accommodate the horizontal lever locking mechanism described hereinabove.

The alternative embodiment includes an insert 36 having a space 37 for movement of a lever arm 40 pivotally mounted on a post 38 and biased by spring 39. The action of the mechanism is as before. The upper operating end 41 of lever 40 is moved inwardly by contact with wall 27 from solid line position "E" to broken line position "F" causing lower outwardly angled locking end 42 to pivot rearwardly a sufficient distance to allow for movement of member 29 to the upraised weight-release position. Spring 39 has a fixed end 44 mounted on projection 43 and movable end 45 as understood in the art. Here again, the specific dimensions of the locking mechanism 36 depend upon the application in which it is used.

The embodiment of FIG. 7 is shown with part of the body of the insert 36 cut away. It is to be understood that post 38 need not be mounted at either end as with axle 20 but could be an extending rod provided that unacceptable force is not present due to spring 39. It is also to be understood that other spring designs may be used if so desired.

Figure 8:
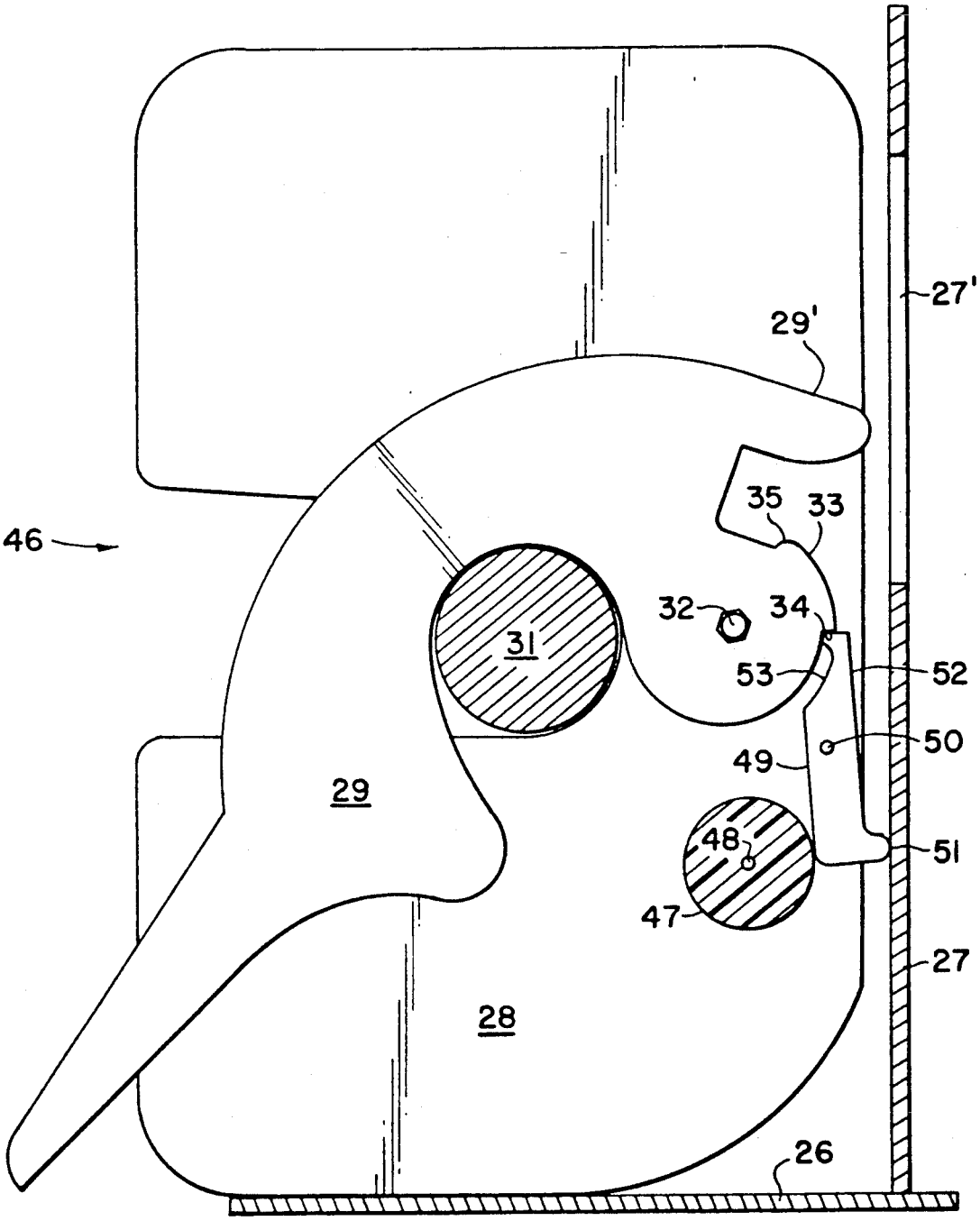
FIG. 8 is a right side view of the preferred embodiment of the locking mechanism in accord with the present invention shown in the locked position.

The preferred embodiment of the locking mechanism in accord with the present invention is depicted at 46 in FIG. 8. A rubber wheel 47 is rotatably mounted on pin 48 to the weight 28. The locking mechanism lever 49 includes an operating end 51 and a locking end 52 and is pivotally mounted to weight 28 via pin 50. The lever 49 and locking member 29 are both made of ⅛" thick steel plate.

The lever 49 is illustrated in FIG. 8 in the locking position whereby member 29 is locked downwardly to secure the weight 28 to the bar 31. Surface 34 is positioned against the locking end 52 of lever 49 and cannot be moved downwardly to an opening or release position. When operating end 51 comes into contact with wall 27 or any other fixed object, the end 51 is forced against a resilient member in the form of a rubber wheel 47 which will yield sufficiently to allow lever 49 to pivot locking end 52 rearwardly and allow it to clear rib 33.

Figure 9:
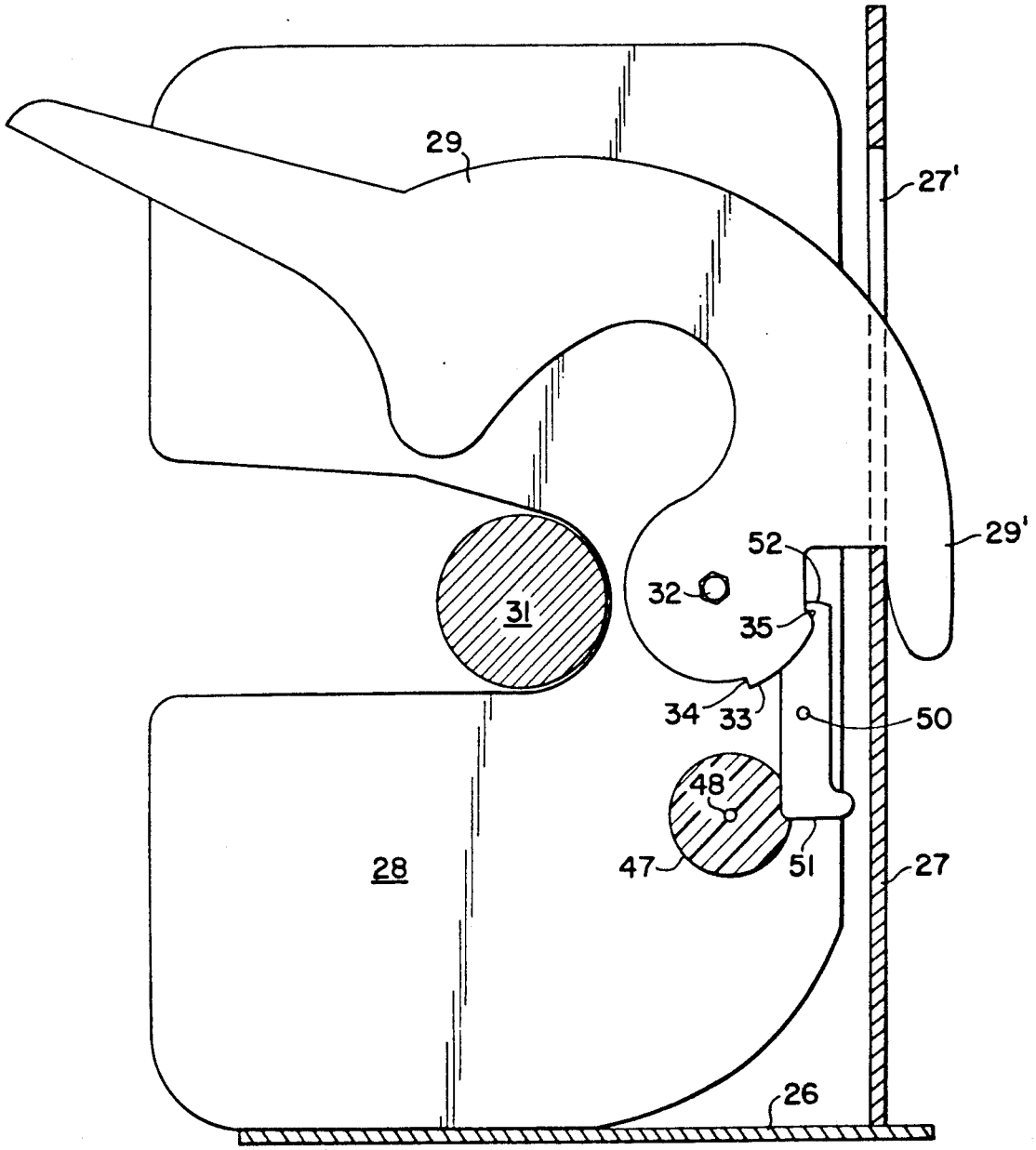
FIG. 9 is a right side view of the mechanism of FIG. 8 in the upraised unlocked position.

When member 29 is raised upwardly as illustrated in FIG. 9, the curved surface 53 of lever locking end 52 engages rib 33 as shown and extends onto surface 35. Operating end 51 remains compressed against wheel 47. Member 29 is held in the up position but can be lowered when lever end 51 clears the wall 27 or other structure that forces it against the wheel 47. Member 29 can then be pulled downwardly to secure the respective weight 28 to bar 31.

The position of wheel 47 with respect to the operating end 51 of lever 49 will result in a slight rotation of wheel 47 each cycle of "release and secure" operation of the locking mechanism 46. This design distributes the wear caused by lever 49 equally around the circumference of wheel 47 to ensure a long life of the component. It is to be understood that wheel 47 may be a leaf spring or the like, if desired, it being important only that lever 49 is biased towards its securing/locking position with respect to member 29.

In all embodiments of the improved locking mechanism in accord with the present invention, the securing of the member 29 in the down position is designed to be a positive locking action to prevent accidental release of the weight 28. The securing of the member 29 in the upraised position is designed to be a retaining or non-positive locking action to hold the member upwardly thus making it easier to secure a weight 28 to the bar by simply pulling the member 29 downwardly and to provide indication to the user as to which weights 28 have been selected. Furthermore, while wall 27 will be the usual device by which contact is made with a given lever, any other fixed element will do and the element need not be part of the weight support structure. Finally, the wall 27 or other element used to operate a given embodiment of the lever could be a movable device moved into position by levers or any other mechanism appropriate in the circumstances.

Figure 11:
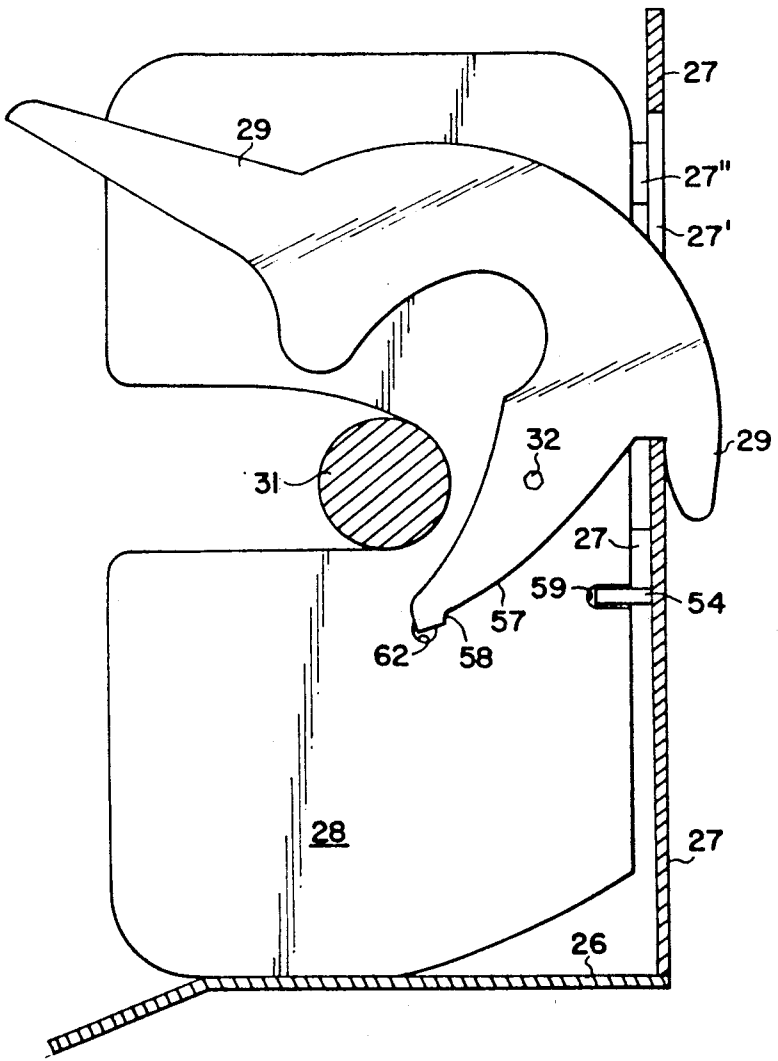
FIG. 11 illustrates the locking arm of FIG. 10 in the upraised position.
Figure 10:
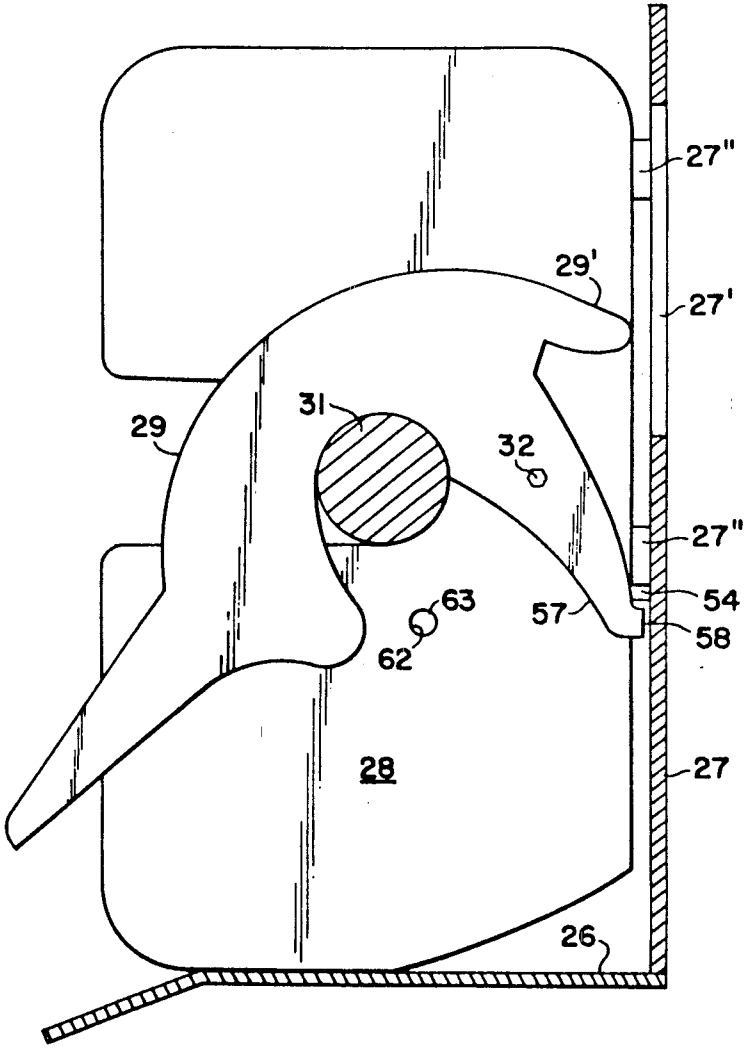
FIG. 10 is a right side elevation view of an alternate locking mechanism in accord with the present invention with the locking arm positioned to block movement of a weight.

FIGS. 10–13 illustrate another embodiment of the invention wherein the locking mechanism 53 includes a wedge 54, with a sloping or angled edge 55 and straight edge or side 56, which is formed integrally with rear tray wall 27. The movable member 29 includes an integral extension arm 57 having a 90° angled portion of tab 58 (FIGS. 12–13) which fits rearwardly of the weight 28 and against rearward weight surface 28'. It can be seen that upward movement of the member 29 from the down weight-securing position of FIG. 10 to the position of FIG. 11 is not possible because of contact between tab 58 with rearward surface 28' unless the tab 58 is moved laterally. As more clearly shown in FIG. 13, wedge 54 will force arm 57 outwardly in a direction to allow tab 58 to clear the rear surface 28' of the weight 28. Wedge 54 fits within a milled slot 59 having a straight wall 60 and an end wall 61 that is formed along the right rear portion of weight 28. As the weight 28 is pushed rearwardly when an exercise is completed, wedge 54 fits into slot 59 and contacts a portion of arm 57 physically higher than tab 58. Arm 57 is deformed outwardly allowing tab 58 to clear weight 28 for movement of member 59 upwardly to release the weights 28 from bar 31. Wall 60 and wedge edge 56 are preferably straight to minimize the likelihood of misalignment of the weight 28 during the action of wedge 54 against arm 57.

Figure 12:
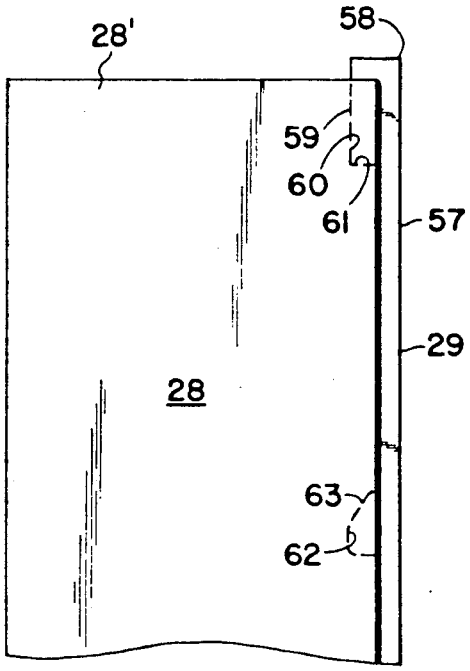
FIG. 12 is an enlarged partial top view of the locking mechanism of FIG. 10 shown to block movement of the locking arm.
Figure 13:
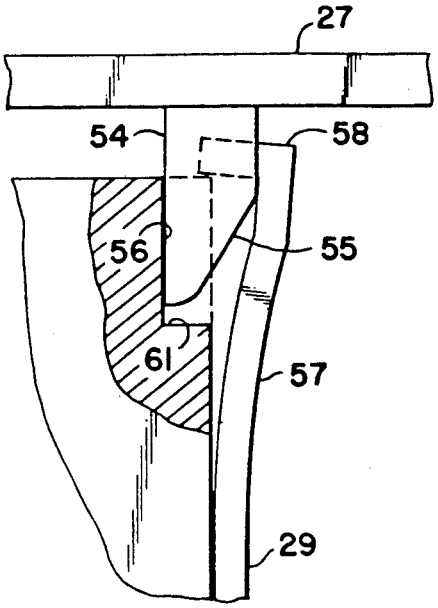
FIG. 13 is an enlarged detail of the locking mechanism of FIG. 12 positioned to allow movement of the locking arm.

With reference to FIGS. 11–13, the length of tab 58, the bending movement of arm 57, and the width of wedge 54 are set to provide that a portion of tab 58 is positionable behind the weight 28 as the weight 28 is brought forwardly and arm 57 rides off wedge 54. This provides that tab 58 will be behind the weight 28 thus locking member 29 downwardly well before the bar 31 is pulled forwardly in the weight tray 26. This provides additional assurance that the selected weights 28 are secured to bar 31 via member 29 locked downwardly before the bar 31 is moved forwardly any appreciable distance. Clearance and sound reduction are provided by rubber spacers 27''.

The securing member 29 is non-positively locked in the up or weight-released position of FIG. 11 by the positioning of tab 58 into a hole or slot 62 formed in weight 28. The member 29 can be pushed downwardly because the rearward edge 63 of hole 62 is formed as a ramp to allow tab 58 to be forced outwardly by downward force on the front portion of member 29.

Figure 14:
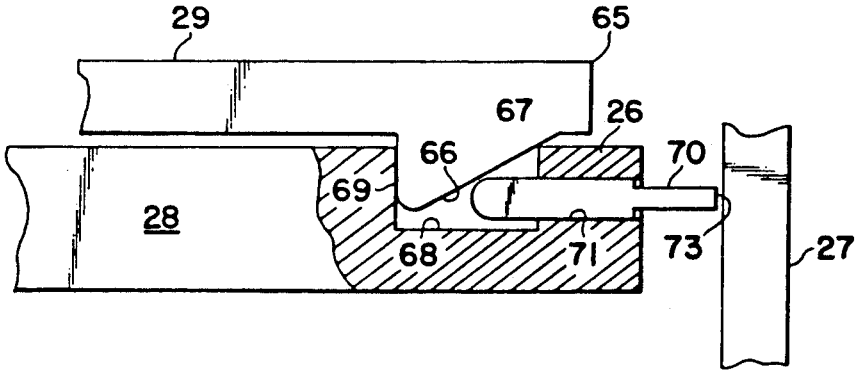
FIG. 14 is a partial cross-sectional view of another embodiment of the locking mechanism in accord with the present invention.

Another embodiment of the improved locking mechanism is illustrated in FIG. 14. The movable locking member 29 has an inward selection element 65 formed on the end thereof having an inwardly disposed sloped locking portion 66 which fits within locking slot 67 to lock member 29 in the down position to secure the weight 28 to the lifting bar 31 as before. Locking portion 66 fits into slot 67 via the resiliency of member 29, which is preferably made of spring metal.

Locking portion 66 is forced out of slot 67 a sufficient distance to allow the member 29 to be rotated upwardly to release a weight 28 by push rod 70 mounted rearwardly in a slot 71. The tray contact end 73 will contact tray wall 27 forcing unlocking end 72 against portion 66 causing it to be pushed outwardly for release action.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to be secured by Letters Patent of the United States is:

1. In a barbell weight lifting apparatus comprising an elongated lifting bar, a plurality of planar weight means adapted to be selectively attached to said bar, support means to position said weight means upstanding in a horizontal row, each said weight means including a movable member and a weight having an identically positioned horizontally disposed lateral slot therein extending from an edge of said weight to generally medially thereof, said bar being positionable through each said slot at respective said weights and being selectively secured to said weights, each said member having a first position wherein said member is downwardly disposed transversing said slot of its respective said weight for securing said lifting bar in said slot and a second position wherein said member is disposed away from said slot for allowing free movement of said bar into and out of said slot, the improvement comprising selectively operable locking means carried by each said weight means for positively locking said member in said first position and preventing any unlocking thereof while said weight is attached to said bar, said locking means being unaffected by intentional or inadvertent movement of said member while said weight is being supported on said bar, said member including a shoulder, said locking means being positionable closely adjacent said shoulder when said member is in said first position to block movement of said member by contact between said shoulder and said locking means.

2. In the apparatus as defined in claim 1 wherein said locking means includes an element selectively positionable to block movement of said member from said first position by contact therewith, said locking means further including means for selective operation of said locking means to move said element from a locked position in which said member is immovable from said first position when said element has been positioned to block such movement and an unlocked position in which said member is movable from said first position.

3. In the apparatus as defined in claim 2 wherein said element is biased in a direction to position said element in said locked position.

4. In the apparatus as defined in claim 3 wherein said locking means is operable by said means for selective operation to override the bias of said element to position said element in said unlocked position.

5. In the apparatus as defined in claim 2 wherein said means for selective operation of said locking means includes a fixed second element.

6. In the apparatus as defined in claim 5 wherein said member includes a forward portion and a rearward portion, said rearward portion having a downwardly disposed hook member, said fixed second element having a plurality of laterally spaced slots for selective engagement by said hook members of respective said members.

7. In the apparatus as defined in claim 5 wherein said second element is positioned to be closely adjacent said weights when said weights are upstandingly supported in a horizontal row by said support means.

8. In the apparatus as defined in claim 2 wherein, said element is positionable closely adjacent said shoulder in said locked position to block movement of said member by contact between said shoulder and said element.

9. In a weight lifting apparatus comprising an elongated horizontal lifting bar, a plurality of planar weight means adapted to be selectively attached to said bar, support means for positioning said weight means upstanding in a horizontal row, each said weight means including a movable member and a weight having an identically positioned horizontally disposed lateral slot therein extending from an edge of said weight to generally medially thereof, said bar being positionable through each said slot at respective said weights and being selectively secured to said weights, each said member having a first position wherein said member is downwardly disposed and at least partially blocking said slot of its respective said weight for securing said lifting bar in said slot and a second position wherein said member is disposed away from and unblocking said slot for allowing free movement of said bar into and out of said slot, the improvement comprising selectively operable locking means carried by each said weight means for locking said member in said first position to prevent unlocking thereof while said weight is attached to said bar and to secure said member in said second position, said locking means being unaffected by intentional or inadvertent movement of said member while said weight is being supported on said bar, said member including a laterally extending rib, said locking means being positionable closely adjacent said ib when said member is in said first position to block movement of said member by contact between said rib and said locking means.

10. In the apparatus as defined in claim 9 wherein laterally extending rib has opposite end portions, each said end portion having a surface for contact with said locking means, said locking means including a biased lever arm pivotally mounted on each said weight, said lever arm having a locking end portion and an operating end portion, said locking end portion being selectively positionable closely adjacent a respective said surface of said end portion for inhibiting movement of said member from a respective said first position by contact between said surface and said locking end portion.

11. In the apparatus as defined in claim 10 wherein said support means includes means to engage said member when said member is in said second position to prevent movement of said weight.

12. In the apparatus as defined in claim 10 wherein said apparatus includes a wall, said locking means being situated to move said lever arm when contacted by said wall when said weight is moved adjacent said wall which in turn moves said locking end of said lever arm away from said surface when contacted and allowed said member to be moved away from said first position.

13. In the apparatus as defined in claim 12 wherein said lever arm is biased for causing movement of said locking end portion of said lever arm closely adjacent said surface when said weight is moved away from said wall sufficiently to be free of contact between said lever arm and said wall.

14. In the apparatus as defined in claim 10 wherein said support means includes a wall, said locking means being located to position said operating end portion of said lever arm to contact said wall when said weight is positioned adjacent said wall to move said locking end portion of said lever arm away from said surface when said operating end portion is contacted by said wall and allowing said member to be moved from said first position to said second position.

15. In the apparatus as defined in claim 14 wherein said member includes a forward portion and a rearward portion, said rearward portion having a downwardly disposed tab portion, said wall including a plurality of laterally spaced slots for selective engagement by said tab portion of respective said members.

16. In the apparatus as defined in claim 10 wherein said lever arm is pivotally mounted substantially in a horizontal plane.

17. In the apparatus as defined in claim 10 wherein said lever arm is pivotally mounted substantially in a vertical plane.

18. In a barbell weight lifting apparatus comprising an elongated horizontal lifting bar, a plurality of planar weight means adapted to be selectively attached to said bar, support means for positioning said weight means upstanding in a horizontal row, each said weight means including a movable member and a weight having an identically positioned horizontally disposed lateral slot therein extending from an edge of said weight to generally medially thereof, said bar being positionable through each said slot at respective said weights and being selectively secured to said weights, each said member having a first position wherein said member is downwardly disposed and at least partially blocking said slot of its respective said weight for securing said lifting bar in said slot and a second position wherein said member is disposed away from and unblocking said slot for allowing free movement of said bar into and out of said slot, the improvement comprising selectively operable locking means carried by each said weight means for preventing said member in said first position rom being moved from said first position until said locking means has been operated and preventing unlocking thereof while said weight is attached to said bar, said locking means being unaffected by intentional or inadvertent movement of said member while said weight is being supported on said bar, said member including a shoulder, said locking means being positionable closely adjacent said shoulder when said member is in said first position to block movement of said member by contact between said shoulder and said locking means.

19. In the apparatus as defined in claim 18 wherein said locking means includes an element and means to position said element to prevent movement of said member from said first position by contact with said shoulder, said element being selectively operable to position said element away from said member to allow for movement thereof from said first position.

20. In the apparatus as defined in claim 19 wherein said apparatus includes means to operate said element away from said member by contact between said support means and said element.

21. In the apparatus as defined in claim 19 wherein said means to position said element includes a spring mounted between said element and said weight.

22. In the apparatus as defined in claim 20 wherein said means to operate said element includes a wall which is contacted by said element to move said element away from said member to release said member for movement.

23. In the apparatus as defined in claim 22 wherein said member includes a forward portion and a rearward portion, said rearward portion having a downwardly disposed hook member, said wall including means for selective engagement by each of said hook members of respective said members to maintain unselected said weights in said horizontal row.

24. In the apparatus of claim 9 wherein said locking means includes an elongated lever pivotally attached and pivoting about a horizontal axis, said lever having an upper end portion engagable with said member and a lower end portion, biasing means connected to said weight and engaged with said lower end portion to bias said upper end portion of said lever towards said member.

25. In the apparatus of claim 24 wherein said biasing means includes a resilient element, and means for connecting said element for rotative movement about a horizontal axis substantially parallel to said horizontal axis of said lever.

26. In the apparatus of claim 25 wherein said resilient element rotates upon each cyclical compressive movement of said lever to distribute wear of said resilient element throughout its outer surface.

27. In a barbell weight lifting apparatus comprising an elongated lifting bar, a plurality of planar weight means adapted to be selectively attached to said bar, support means to position said weight means upstanding in a horizontal row, each said weight means including a movable member and a weight having an identically positioned horizontally disposed lateral slot therein extending from an edge of said weight to generally medially thereof, said bar being positionable through each said slot at respective said weights and being selectively secured to said weights, each said member having a first position wherein said member is downwardly disposed transversing said slot of its respective said weight for securing said lifting bar in said slot and a second position wherein said member is disposed away from said slot for allowing free movement of said bar into and out of said slot, the improvement comprising selectively operable locking means carried by each said weight means for positively and selectively locking said member in said first position and preventing unlocking thereof while said weight is attached to said bar, said locking means being unaffected by intentional or inadvertent movement of said member while said weight is being supported on said bar without prior operation of said locking means.

28. In the apparatus as defined in claim 27 wherein said locking means includes an element attached to said member and selectively positionable to block movement of said member from said first position by contact with said weight, said support means further including means for selective operation of said locking means to move said element from a locked position in which said member is immovable from said first position when said element has been positioned to block such movement and an unlocked position in which said member is movable from said first position.

29. In the apparatus as defined in claim 28 wherein said element is biased in a direction to position said element in said locked position when said member has been operated to said first position.

30. In the apparatus as defined in claim 29 wherein said locking means is operable by said means for selective operation to override the bias of said element to position said element in said unlocked position.

31. In the apparatus as defined in claim 28 wherein said means for selective operation of said locking means includes a fixed second element.

32. In the apparatus as defined in claim 31 wherein said member includes a forward portion and a rearward portion, said rearward portion having a downwardly disposed hook member, said wall having a plurality of laterally spaced slots for selective engagement by said hook members of respective said members.

33. In the apparatus as defined in claim 31 wherein said second element is positioned to be closely adjacent said weights when said weights are upstandingly supported in a horizontal row by said support means.

34. In the apparatus as defined in claim 31 wherein said fixed second element is formed as a laterally extending wedge to engage said element and applying a lateral force thereto in order to overcome said bias to move said element from said locked position.

35. In the apparatus as defined in claim 28 wherein said member is spring metal to have sufficient bias to position said element in said locked position when said member has been operated to said first position.

36. In the apparatus as defined in claim 28 wherein said element is an angled tab to engage a said edge of said weight.

37. In the apparatus as defined in claim 27 wherein said locking means includes an element integral with said member and selectively positionable to block movement of said member from said first position by contact with said weight therewith, said locking means further including means carried by said weight for selective operation of said locking means to move said element from a locked position in which said member is immovable from said first position when said element has been positioned to block such movement and an unlocked position in which said member is movable from said first position.

38. In the apparatus as defined in claim 37 wherein said element is biased in a direction to position said element in said locked position.

39. In the apparatus as defined in claim 38 wherein said locking means is operable by said means for selective operation to override the bias of said element to position said element in said unlocked position.

40. In the apparatus as defined in claim 37 wherein said means for selective operation of said locking means includes a movable second element mounted in said weight.

41. In the apparatus as defined in claim 40 wherein said second element is positioned to be closely adjacent said weights when said weights are upstandingly supported in a horizontal row by said support means.

* * * * *